United States Patent [19]

Klein

[11] 4,271,932

[45] Jun. 9, 1981

[54] ELEVATOR GUIDE SHOE

[75] Inventor: Wolfgang Klein, Bergisch-Gladbach, Fed. Rep. of Germany

[73] Assignee: Acla-Werke Aktiengesellschaft, Fed. Rep. of Germany

[21] Appl. No.: 938,900

[22] Filed: Sep. 1, 1978

[30] Foreign Application Priority Data

Sep. 10, 1977 [DE] Fed. Rep. of Germany ... 7728040[U]

[51] Int. Cl.[3] ..... B66B 7/02

[52] U.S. Cl. ..... 187/95; 308/3 B

[58] Field of Search ..... 187/95, 6, 9 R; 214/670, 660; 308/3 R, 3 B, 6 R; 104/119

[56] References Cited

U.S. PATENT DOCUMENTS

| | | | |
|---|---|---|---|
| 1,206,350 | 11/1916 | Meech | 187/95 |
| 2,103,480 | 12/1937 | Mason | 187/95 |
| 2,743,966 | 5/1956 | McKernan | 187/95 |
| 3,517,774 | 6/1970 | Meyer | 187/95 |
| 4,095,677 | 6/1978 | Johannson | 187/95 |

FOREIGN PATENT DOCUMENTS

| | | | |
|---|---|---|---|
| 1237005 | 10/1959 | France | 187/95 |
| 2003241 | 3/1969 | France | 187/95 |
| 359526 | 2/1962 | Switzerland | 187/95 |

*Primary Examiner*—Robert J. Spar
*Assistant Examiner*—Kenneth Noland
*Attorney, Agent, or Firm*—Thomas R. Morrison

[57] ABSTRACT

A guide shoe for an elevator has a rigid holding shoe for attachment to the elevator car. A U-shaped recess in the holding shoe accommodates a laminated slide member having a liner adapted to resist frictional wear and attack by lubricants and an intermediate layer between the liner and the holding shoe of cellular elastomeric material.

12 Claims, 6 Drawing Figures

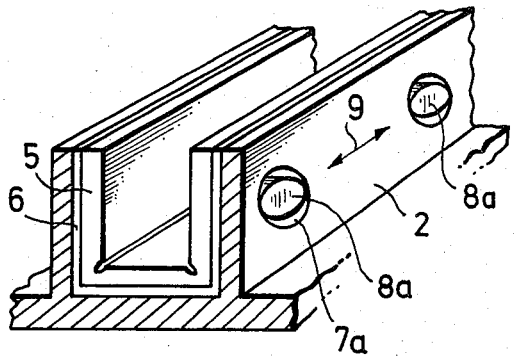
FIG.4
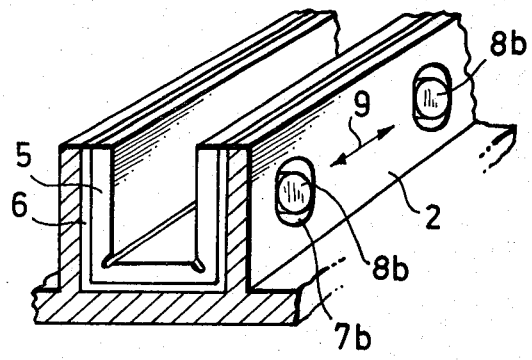
FIG.5
FIG. 6
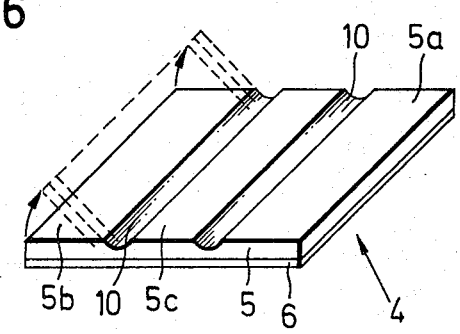

ELEVATOR GUIDE SHOE

BACKGROUND OF THE INVENTION

This invention relates to a guide shoe for the car of an elevator sliding along a guide rail, which consists of a holding shoe and a liner arranged in a longitudinal recess in the holding shoe.

Sliding guide shoes on elevators are for the safe guidance of the car. In view of the different functions of the holding shoe and the liner, different materials are used therefor. The holding shoe is made of a rigid material, e.g. metal or thermosetting plastics, while the liner is made of a different kind of plastic.

The holding shoe is the load-bearing member, it is attached to the car and holds the liner in position. The liner slides on the rail. It determines the smoothness of travel of the elevator. It must be elastically damping, and having abrasive resistance and very good sliding ability. Moreover, it must be resistant to the lubricants used. The connection between the liner and the holding shoe is effected by means of pins, which are fixed component parts of the liner, and engage in corresponding holes in the holding shoe.

The materials previously used for the liners represent a compromise between good sliding ability and elastic damping properties. They cannot simultaneously satisfy the technical requirement of optimum sliding ability, low coefficient of friction, in some cases even without lubricant, wear and greater elasticity.

SUMMARY OF THE INVENTION

An object of the invention is to provide a slide shoe for a car or the like, in which the liner can respond better than hitherto to the requirements to be placed upon it for sliding ability, wear and elastic damping properties, and in which lateral movement without longitudinal movement is possible.

The sliding guide shoe according to the present invention employs an intermediate layer of cellular elastomer between the holding shoe and the liner. Any appropriate cellular elastomer may be used but best results are obtained with an elastomer with a polyurethane base.

The use of different material for the liner and the intermediate layer better satisfy the different requirements to be placed on the sliding guide shoe and the liner. The liner can be made of a material which has extremely low coefficient of friction and high resistance to abrasion without requiring the compromises which would otherwise be needed to achieve elasticity. Although numerous materials may be satisfactory for the liner, in the preferred embodiment a plastic liner made of polyamides is preferred. The intermediate layer of cellular elastomer provides elasticity to the liner without itself being subjected to abrasion and wear from contact with the rail. In addition, the cellular elastomer adds the desirable property of damping noise from the sliding friction contact of the liner with the rail before it can propagate into the car. In the preferred embodiment, a cellular elastomer employing a polyurethane base gives the best results.

The liner and the intermediate layer are preferably secured together into an integral unit, for example by glueing. Thus, the sliding guide element operates as a unit and combines in itself the desired technical properties in a novel manner which yields an unexpectedly improved result.

According to a further characteristic of the invention, the pins of the liner pass through the intermediate layer of cellular elastomer in order to engage holes in the holding shoe. The pins are integral components of the liner and are made of the same material. The interengagement of the pins of the liner and the holes in the holding shoe is so arranged that relative movement in the longitudinal direction between the liner and the holder shoe is prevented while relative movement in the transverse direction is permitted. Such transverse movement can be attained in different ways. For example, pins having an oval shape with the maxor axis disposed longitudinally of the travel direction may be fitted into circular holes in the holding shoe. The greater size of the pins in the longitudinal direction corresponds to the size of the diameter of the holes in the holder shoe and prevents relative longitudinal motion while permitting transverse motion. Pins having a circular shape may engage transverse slots in the holder shoe. The diameter of the pins corresponds to the longitudinal dimension of the slots in the direction of travel thus limiting relative movement in this direction. The greater dimension of the slots extending transversely of the direction of travel permits substantial relative transverse movement of the pins in the slots.

The two described measures permit the desired transverse movement, without permitting substantial movement in the longitudinal direction. The intermediate layer made of cellular elastomer absorbs transverse movement elastically. Shocks and travel noises are dampened and cannot be transmitted through the holding shoe to the car.

The thickness and cellular structure of the intermediate layer can readily be chosen by one skilled in the art for a specific application to achieve the properties of a predetermined stress during normal functioning, the necessary elastic-springing and satisfactory noise damping. The thickness of the intermediate layer may correspond approximately to the thickness of the liner, but is preferably somewhat less. It can, however, for suitable cellular material, exceed the thickness of the liner.

The liner, when installed, is of substantially U-shape in cross-section. The material with its elastic properties permits simple assembly, and the liner can be inserted into the holder shoe by pressing together the two side walls of the liner while inserting into the holding shoe until the pins snap into the holes. Although the liner according to the invention may be molded in its final U shape, there is preferably provided another insertion technique for the unit. According to a further feature of the invention, the liner, which consists of the side walls and the base, is formed as a flat laminated body. The liner has two longitudinally extending grooves, so called film hinges, which permit bending the side walls up into U-form during assembly.

The cellular intermediate layer can be stamped from a flat sheet material. It is applied to the flat liner on the side on which the pins are located. During assembly, the two outer walls of the liner are bent up, and the attached intermediate layer also bends without difficulty. Engagement of the pins in the holes of the holding shoe takes place by snap action.

BRIEF DESCRIPTION OF THE DRAWINGS

The invention is explained below with reference to the exemplary embodiment shown in the drawings:

FIGS. 4 and 5 show, schematically, and in cross-section, two exemplary embodiments for engagement between pins on the liner and holes in the holding shoe.

FIG. 6 shows the liner and intermediate layer of the combined slide element prior to insertion into the holding shoe.

DETAILED DESCRIPTION OF THE PREFERRED EMBODIMENT

Figure 1:
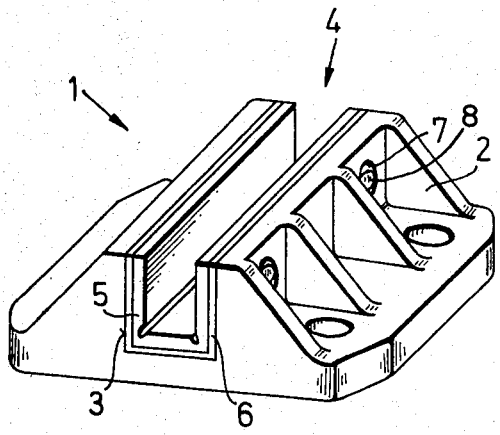
FIG. 1 shows an embodiment of the guide shoe according to the invention in perspective and schematically.
Figure 2:
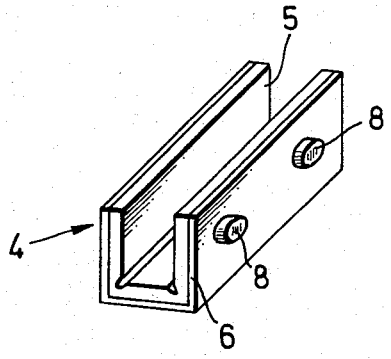
FIG. 2 shows schematically the combined slide member according to the invention, in perspective.
Figure 3:
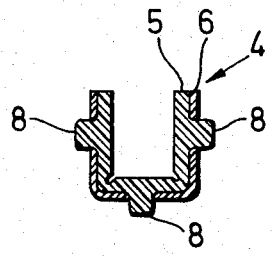
FIG. 3 is a cross-section through the combined slide element of FIG. 2 in the plane of the projecting pins.

The guide shoe 1 has a holding shoe 2 with a slide member 4 located in a longitudinal recess 3. The slide member 4 consists of a liner 5 of a first type of plastic and an intermediate layer 6 of a different type of plastic. The liner 5 and the intermediate layer 6 are firmly bonded together at their junction to form a unitary body. The type of plastic in liner 5 is selected from those giving good resistance to abrasion and low friction such as certain elastomers and polyamides and the like, but is preferably polyamide. The plastic material in the intermediate layer 6 is preferably a cellular material and, in the preferred embodiment is a cellular polyurethane. In the holding shoe 2, holes 7 are provided in which the pins 8 on the liner 5 engage.

The engagement of the pins 8 of the liner 4, which project through the intermediate layer 6 surrounding the liner 4, with the holes 7 in the holding shoe 2 can be arranged in different ways to attain movement in the direction of the depth of the hole 3 in the holder shoe 2. According to FIG. 4, the pins 8*a* have an oval shape. Thus, the dimension of the pins 8*a* transverse to the direction of travel indicated by the arrow 9 is smaller than the dimension of the pin 8*a* longitudinally of the direction of travel. The hole 7*a* has a circular shape. Alternatively, the embodiment of FIG. 5 shows pins 8*b* having a circular shape, and holes 7*b* having a slotted shape. The diameter of the pin 8*b* corresponds to the width of the slot 7*b* longitudinal to the direction of travel, while the greater dimension of the slot 7*b* extends transversely to the direction of travel. Both embodiments permit relative movement of the slide member 4 transversely to the direction of travel, while longitudinal movement of the slide member 4 relative to the holding shoe 1 in the direction of travel is prevented.

FIG. 6 shows the slide member 4 consisting of the liner 5 and intermediate layer 6 prior to assembly in the holding shoe, the view being in the direction of the sliding surface of the liner 5. The side walls 5*a* and 5*b* lie in the same plane as the base 5*c* of the liner. The fixing pins 8, 8*a*, 8*b* are located on the underside of the slide member and are not shown. The intermediate layer 6 of cellular-elastomer is fixedly secured to the liner 5. The liner 5 has longitudinally extending grooves 10 formed by reduction of the material, which provide so called film hinges. During assembly, the side walls 5*a* and 5*b* of the liner together with the intermediate layer 6, is bent along the grooves 10 into U-shape. The U-shaped body so formed is fitted into the longitudinal recess 3 in the holding shoe 2. The pins 8, 8*a*, 8*b* snap into the corresponding holes 7, 7*a*, 7*b* so that the slide member is fixed in the holding shoe 2.

It will be understood that the claims are intended to cover all changes and modifications of the preferred embodiments of the invention, herein chosen for the purpose of illustration which do not constitute departures from the spirit and scope of the invention.

What is claimed is:

1. A guide shoe for attachment to the car of an elevator and for sliding on a guide rail in a hoistway, comprising: a holding shoe made of rigid material and having a U-shaped longitudinal recess therein, a liner of U-shaped cross-section, said liner being made of plastic material, the liner and holding shoe being secured together by pins integrally formed with said liner extending outward from said liner to engage in corresponding holes in the holding shoe, an intermediate layer of cellular elastomer between the holding shoe and the liner and said pins extending through said intermediate layer and engaging said holes whereby said pins are also effective to prevent substantial translation of said intermediate layer with respect to said liner.

2. A guide shoe according to claim 1, wherein the liner and the intermediate layer are adhesively secured together to form an integral slide member.

3. A guide shoe according to claim 1, further including means in the engagement of the pins on the liner with holes in the holding shoe for permitting relative movement between the slide member and the holding shoe transversely to the longitudinal direction, and for preventing relative movement therebetween in the longitudinal direction.

4. A guide shoe for attachment to the car of an elevator and for sliding on a guide rail in a hoistway, comprising: a holding shoe made of rigid material and having a U-shaped longitudinal recess therein, a liner of U-shaped cross-section, said liner being made of plastic material, the liner and holding shoe being secured together by pins formed with said liner which engage in corresponding holes in the holding shoe, an intermediate layer of cellular elastomer between the holding shoe and the liner, said pins through said intermediate layer and wherein the two side walls and base of the U-shaped liner are formed as a flat laminated body, two longitudinally extending generally parallel grooves partially through the thickness of said plastic material being formed in said liner, the remaining portion of said thickness of said plastic material in said grooves forming film hinges, which permit bending up the two side walls together with the intermediate layer into its U-shaped cross section during assembly.

5. A guide shoe for attachment to the car of an elevator and for sliding on a guide rail in a hoistway, comprising: a holding shoe made of rigid material and having a U-shaped longitudinal recess therein, a liner of U-shaped cross-section, said liner being made of plastic material, the liner and holding shoe being secured together by pins formed with said liner which engage in corresponding holes in the holding shoe, an intermediate layer of cellular elastomer between the holding shoe and the liner, said pins passing through said intermediate layer, means for permitting relative movement between the liner and the holding shoe transversely to the longitudinal direction, and for preventing relative movement therebetween in the longitudinal direction and wherein said means comprises said pins on the liner being of oval shape and said holes being of circular shape, the size of the pins in the direction transverse to the direction of travel being smaller than in the longitudinal direction, and the size of the pins and the holes in the direction of travel being substantially equal, so that, only transverse movement is possible between the slide member and the holding shoe and longitudinal movement is prevented.

6. A guide shoe for attachment to the car of an elevator and for sliding on a guide rail in a hoistway, comprising: a holding shoe made of rigid material and having a U-shaped longitudinal recess therein, a liner of U-shaped cross-section, said liner being made of plastic material, the liner and holding shoe being secured together by pins formed with said liner which engage in corresponding holes in the holding shoe, an intermediate layer of cellular elastomer between the holding shoe and the liner, said pins passing through said intermediate layer, means for permitting relative movement between the liner and the holding shoe transversely to the longitudinal direction, and for preventing relative movement therebetween in the longitudinal direction and wherein said means comprises said pins on the liner being of circular shape, and said holes being slots, the size of the slots transversely to the direction of travel being greater than in the direction longitudinally thereof, and size of the pins and the slots in the direction of travel being substantially the same, so that, only lateral movement is possible between the slide member and the holding shoe and longitudinal movement is prevented.

7. A guide shoe comprising:

(a) a holding shoe having a U-shaped recess therein;

(b) a slide member having a U-shaped cross section moveably fitted within and conforming to the inside of said recess;

(c) said slide member having first and second layers;

(d) said first layer abutting said recess and being of cellular elastomeric material;

(e) said second layer being of non-cellular plastic material;

(f) a plurality of pins integrally formed in said second layer;

(g) said pins passing outward through said first layer; and (h) holes in said holding shoe aligned with said pins and engageable therewith for resisting relative motion of said second layer with respect to said holding shoe in at least a direction of motion.

8. The guide shoe according to claim 7, wherein said pins and holes fit snugly in the direction of motion of said guide shoe and fit loosely transverse to the direction of motion whereby relative motion between said holding shoe and said slide member is permitted in the transverse direction and is prevented in the direction of motion.

9. A guide shoe according to claim 8; wherein said pins are round and said holes are oval.

10. A guide shoe according to claim 8; wherein said pins are oval and said holes are round.

11. The guide shoe according to claim 7, wherein said first layer is polyurethane foam, said second layer is polyamide and said first and second layers are adhesively bonded together into an integral unit.

12. A guide shoe according to claim 7; wherein said first and second layers are adhesively bonded together.

* * * * *